US010914032B2

(12) United States Patent
Tong et al.

(10) Patent No.: US 10,914,032 B2
(45) Date of Patent: Feb. 9, 2021

(54) SMART CLOTHESHORSE AND METHOD FOR CONTROLLING HANGER IN SMART CLOTHESHORSE

(71) Applicant: BOE TECHNOLOGY GROUP CO., LTD., Beijing (CN)

(72) Inventors: Lu Tong, Beijing (CN); Tianyue Zhao, Beijing (CN); Xiao Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 182 days.

(21) Appl. No.: 15/952,156

(22) Filed: Apr. 12, 2018

(65) Prior Publication Data

US 2019/0055691 A1 Feb. 21, 2019

(30) Foreign Application Priority Data

Aug. 18, 2017 (CN) ..... 2017 1 0713108

(51) Int. Cl.
*D06F 57/06* (2006.01)

(52) U.S. Cl.
CPC ..... *D06F 57/06* (2013.01); *D06F 2202/10* (2013.01)

(58) Field of Classification Search
CPC ..... D06F 57/06; D06F 2202/10; D06F 57/08; D06F 2058/2816; D06F 2058/2854; D06F 58/28; D06F 57/00
See application file for complete search history.

(56) References Cited

FOREIGN PATENT DOCUMENTS

| | | | | |
|---|---|---|---|---|
| CN | 202298243 | U | | 7/2012 |
| CN | 102797141 | A | | 11/2012 |
| CN | 102912601 | A | | 2/2013 |
| CN | 203498672 | U | * | 3/2014 |
| CN | 205368796 | U | | 7/2016 |
| CN | 205697053 | U | * | 11/2016 |
| CN | 206109814 | U | | 4/2017 |
| CN | 106835632 | A | | 6/2017 |
| CN | 206396500 | U | | 8/2017 |

OTHER PUBLICATIONS

Office Action received for Chinese Patent Application No. 201710713108.9, dated Dec. 14, 2018, 15 pages (7 pages of English Translation and 8 pages of Office Action).

* cited by examiner

*Primary Examiner* — Jessica Yuen
(74) *Attorney, Agent, or Firm* — Womble Bond Dickinson (US) LLP

(57) ABSTRACT

The present disclosure provides a smart clotheshorse and a method for controlling a hanger in a smart clotheshorse. The smart clotheshorse includes first supporting poles parallel to each other, a hanger connected between the first supporting poles and configured to be slidable along the first supporting poles, the hanger having a driving device and a control device; and a sensing device. The sensing device is configured to sense environmental information of the hanger. The environmental information includes at least one of humidity information and light intensity information. The control device is configured to control the driving device based on the environmental information. The driving device is configured to drive the hanger to slide along the first supporting poles.

17 Claims, 3 Drawing Sheets

SMART CLOTHESHORSE AND METHOD FOR CONTROLLING HANGER IN SMART CLOTHESHORSE

RELATED APPLICATIONS

The present application claims priority to Chinese Patent Application No. 201710713108.9 filed on Aug. 18, 2017, the entire contents of which are hereby incorporated by reference.

TECHNICAL FIELD

The present disclosure relates to the field of Internet of Things technology used for smart home, and particularly to a smart clotheshorse and a method for controlling a hanger in the smart clotheshorse.

BACKGROUND

With the continuous development of science and technology, smart homes are increasingly receiving favor from people. People hope to solve problems encountered in daily life, such as clothes sunning, through intelligence. At present, the common clotheshorses in use cannot detect the degree of drying of the clothes, the condition of irradiation, etc., which result in uneven sunning or slow drying of the clothes. Basically, to accelerate the drying of the clothes, one has to manually adjust the position of the clothes to place the more wettish clothes in a position with the higher irradiation intensity, which increases people's workload.

SUMMARY

According to an aspect of the present disclosure, there is provided a smart clotheshorse. The smart clotheshorse comprises first supporting poles parallel to each other, a hanger and a sensing device. The hanger is connected between the first supporting poles and configured to be slidable along the first supporting poles. The hanger comprises a driving device and a control device. The sensing device is configured to sense environmental information of the hanger, wherein the environmental information comprises at least one of humidity information and light intensity information. The control device is configured to control the driving device based on the environmental information. The driving device is configured to drive the hanger to slide along the first supporting poles.

In an embodiment, the sensing device comprises a first humidity sensor located at the hanger and a light intensity sensor located at the first supporting pole. The first humidity sensor is configured to sense humidity of the clothes on the hanger. The light intensity sensor is configured to sense a light intensity at a position on the first supporting pole.

In an embodiment, the driving device comprises a motor, a drive shaft and a sliding wheel. Each of the first supporting poles has a first sliding groove. The first sliding grooves are opposite to each other. The motor is configured to control rotation of the drive shaft to cause the sliding wheel to move in the first sliding groove.

In an embodiment, the smart clotheshorse further comprises secondary supporting poles connected with the first supporting poles. Each of the secondary supporting poles has a second sliding groove. The second sliding grooves are opposite to each other and in communication with the corresponding first sliding grooves respectively. The motor is configured to control the rotation of the drive shaft to cause the sliding wheel to move in the first sliding groove or the second sliding groove.

In an embodiment, a side of the second sliding groove away from the first supporting pole has an opening.

In an embodiment, the smart clotheshorse further comprises a lifting mechanism configured to make its top surface rise and fall in a vertical part of the second sliding groove, such that the top surface forms a part of the first sliding groove or the second sliding groove.

In an embodiment, the driving device further comprises a telescopic shaft extending out of both ends of the hanger in an axial direction of the hanger and connected to two sliding wheels respectively. A distance by which the telescopic shaft extends out of both ends of the hanger is controlled.

In an embodiment, the smart clotheshorse further comprises a second supporting pole that is perpendicular to and connected with the first supporting pole.

In an embodiment, the smart clotheshorse further comprises a storage box located directly below the hanger.

In an embodiment, the storage box comprises a body and a cover connected with the body. The cover is angled with a horizontal plane, and a height of an edge of the cover connected with the body is lower than heights of other parts of the cover.

In an embodiment, the cover has a second humidity sensor and an opening-and-closing control device. The second humidity sensor is configured to sense humidity of the cover. The opening-and-closing control device is configured to control opening and closing of the cover based on the humidity of the cover.

In an embodiment, the smart clotheshorse further comprises a water tank. The water tank is arranged to closely adjoins to the body at a lower side of the cover.

In an embodiment, a distance between the neighboring hangers is 10 cm.

In an embodiment, a number of the hangers is 16 to 18.

According to another aspect of the present disclosure, there is provided a method for controlling a hanger in a smart clotheshorse. The smart clotheshorse comprises first supporting poles parallel to each other, a hanger and a sensing device. The hanger connected between the first supporting poles and configured to be slidable along the first supporting poles. The hanger comprises a driving device and a control device. The sensing device is configured to sense environmental information of the hanger. The environmental information comprises at least one of humidity information and light intensity information. The control device is configured to control the driving device based on the environmental information. The driving device is configured to drive the hanger to slide along the first supporting poles. The method comprises sensing humidity of clothes on the hanger; sensing a light intensity at a position on the first supporting pole when the humidity of the clothes is higher than a first preset humidity; and adjusting a position of the hanger based on the humidity and the light intensity.

In an embodiment, the adjusting the position of the hanger based on the humidity and the light intensity comprises: moving a hanger with the clothes of the highest humidity to a position with the highest light intensity.

In an embodiment, the adjusting the position of the hanger based on the humidity and the light intensity further comprises: adjusting a position of the hanger, on which the clothes are hanged respectively, such that a ranking of the humidity of the clothes corresponds to a ranking of the light intensities at the adjusted positions of the hangers.

In an embodiment, the smart clotheshorse comprises a storage box and the method comprises: sensing the humidity of a cover of the storage box; acquiring the humidity of the clothes on the hanger when the humidity of the cover is less than or equal to a second preset humidity; and opening the cover when the humidity of the clothes is less than or equal to the first preset humidity.

In an embodiment, the first supporting pole comprises a first sliding groove, and the smart clotheshorse further comprises a secondary supporting pole connected with the first supporting pole and a lifting mechanism. The secondary supporting pole comprises a second sliding groove, and the second sliding grooves are in communication with the corresponding first sliding grooves respectively. The lifting mechanism is configured to make its top surface rise and fall in a vertical part of the second sliding groove, so that the top surface forms a part of the first sliding groove or the second sliding groove. The method further comprises: exchanging the sequence of the positions of a first hanger and a second hanger in the first sliding groove through the lifting mechanism.

In an embodiment, the exchanging the sequence of the positions of the first hanger and the second hanger in the first sliding groove through the lifting mechanism comprises: moving the first hangers to the top surface of the lifting mechanism; making the top surface of the lifting mechanism fall such that the top surface is flush with a bottom surface of the second sliding groove; moving the first hangers such that the first hangers leaves the top surface of the lifting mechanism; raising the top surface of the lifting mechanism such that the top surface is flush with a bottom surface of the first sliding groove; moving the second hanger at one side of the vertical part of the second sliding groove to the other side of the vertical part of the second sliding groove in the first sliding groove; making the top surface of the lifting mechanism fall such that the top surface is flush with the bottom surface of the second sliding groove; moving the first hanger to the top surface of the lifting mechanism; and raising the top surface of the lifting mechanism such that the top surface is flush with the bottom surface of the first sliding groove.

DETAILED DESCRIPTION

In order to make the above objectives, features, and advantages of the present disclosure more apparent, the present disclosure will be further described below in detail with respect to the accompanying drawings and specific embodiments.

Known clotheshorses cannot detect the dryness of the clothes and the lighting conditions, including the angle and intensity of lighting, etc. This causes an uneven sunning and a slow drying of the clothes. To accelerate the drying, people have to manually adjust the position of the clothes to place the more wettish clothes in a position with the higher irradiation intensity for sunning. This increases people's workload.

Figure 1:
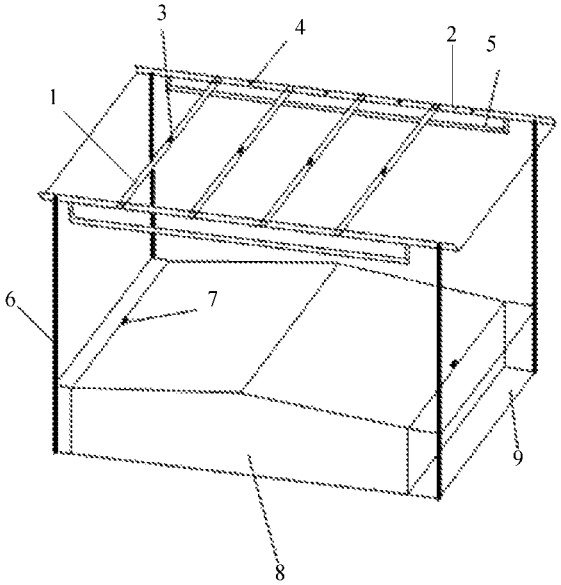
FIG. 1 schematically shows a structure diagram of a smart clotheshorse according to an embodiment of the present disclosure.

According to an aspect of the present disclosure, there is provided a smart clotheshorse. FIG. 1 schematically shows a structural diagram of the smart clotheshorse. As shown in FIG. 1, the smart clotheshorse comprises first supporting poles 2 parallel to each other, a hanger 1, and sensing devices. The hanger 1 is connected between the two first supporting poles 2 and is slidable along the first supporting poles 2, such that a sunning position of the clothes on the hanger 1 can be adjusted along the first supporting poles 2. The sensing devices can be used to sense the environmental information of the hanger 1. The environmental information includes humidity information and light intensity information. Therefore, the sensing devices may include a first humidity sensor 2 and a light intensity sensor 4. The first humidity sensor 2 may be located on the hanger 1. The light intensity sensor 4 can be located on the first supporting pole 2.

In an embodiment, the smart clotheshorse according to the present disclosure may include two or more hangers 1.

Figure 2:
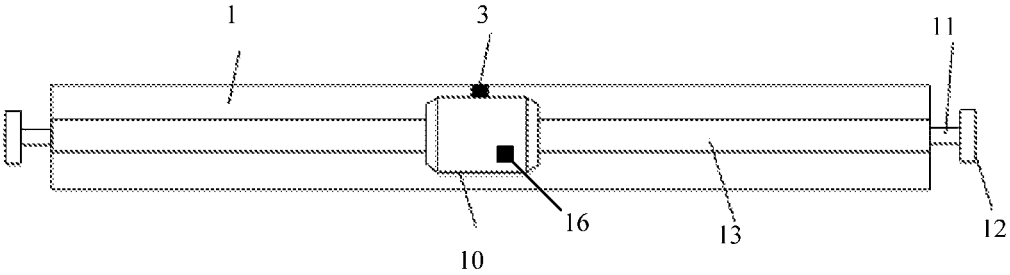
FIG. 2 schematically shows a structure diagram of a hanger, comprising a driving device, used for the smart clotheshorse according to an embodiment of the present disclosure.

FIG. 2 schematically shows a structure of the hanger 1 used in the smart clotheshorse according to the present disclosure. The hanger 1 has a driving device and a control device 16. The location of the control device 16 is not limited on the hanger 1. For example, the control device 16 can be installed on the first supporting pole or any other position on the smart clotheshorse, as long as it can control the operation of the driving device, no matter through wires or wirelessly. The control device 16 could be a processor or a single chip microcomputer or any other suitable devices. The driving device may be used to drive the hanger 1 to slide along the first supporting poles 2. When the environmental information is detected by the sensing devices, the control device 16 may control the driving device based on the environmental information so that the driving device drive the hanger 1 to slide along the first supporting poles 2.

In an embodiment, the humidity information indicates the humidity of the clothes on the hanger 1, and the light intensity information indicates the light intensities of the positions on the first supporting pole 2. After acquiring the humidity information and the light intensity information, the control device 16 may control the driving device to drive the hanger 1 to slide, so as to move the hanger 1 with the more wettish clothes to a position on the first supporting pole 2 with the higher light intensity. This makes it possible to accelerate the drying of the clothes.

In an embodiment, a first preset humidity information for the clothes on the hanger 1 may be set in advance, which reflects a first preset humidity set for the clothes on the hanger 1. When it is detected that the humidity of the clothes on the hanger 1 is higher than the first preset humidity, the position of the hanger 1 may then be adjusted according to the humidity of the clothes on the hanger 1 for further sunning. When the humidity of the clothes on the hanger 1 is less than or equal to the first preset humidity, the position of the hanger 1 can be adjusted for collecting the clothes on the hanger 1. For example, when the humidity on the clothes on the hanger 1 is higher than the first preset humidity, the hanger 1 may be slide to a position with a higher light intensity, to accelerate the drying of the clothes on the hanger 1. When the humidity of the clothes on the hanger 1 is less than or equal to the first preset humidity, the hanger 1 may be slide to collect the clothes or prepare for the collection of the clothes.

In practical applications, it is possible to sun one piece of clothes by two or more hangers 1. Taking two hangers 1 as an example, one implementation is to lay this piece of clothes on the two hangers 1, and another implementation is to fix a part of the clothes (for example, by means of a clip) on one of the two hangers 1 (which in this case is called the fixing hanger) and lay the rest of this piece of clothes on the other hanger 1 (which in this case is called the laying hanger). When adjusting the positions of the hangers, it is needed to control the movement of two or more hangers 1 that are used for sunning the same piece of clothes. It should be understood that the movement of the two or more hangers 1 may be synchronous or asynchronous. For example, in the latter implementation described above, the two hangers 1 may be moved asynchronously so that the distance between the two hangers 1 increases or decreases, thereby controlling the stretching of the clothes, or even making the clothes leave (e.g., slide off) the laying hanger and only present (e.g., hung) on the fixing hanger.

In an embodiment as shown in FIG. 1, the sensing devices may include, for example, a first humidity sensor 3 at the hanger 1, and a light intensity sensor 4 at the first supporting pole 2. The first humidity sensor 3 can detect the humidity of the clothes on the hanger 1. A plurality of light intensity sensors 4 may be disposed on the first supporting pole 2 at intervals to detect the light intensities at the positions on the first supporting pole 2.

It should be understood that in practical applications, the number of the light intensity sensors on the first supporting pole 2 can be determined according to the actual requirement. This is not limited in the present disclosure.

The control device 16 may adjust the positions of the hangers 1 according to the humidity of the clothes on the hangers 1 sensed by the first humidity sensors 3 and the light intensities at the positions on the first supporting pole 2 sensed by the light intensity sensors 4.

In an embodiment as shown in FIG. 1, the first supporting pole 2 further includes a secondary supporting pole 5. Each secondary supporting pole 5 is directly below a respective first supporting pole 2, and the distances between secondary supporting poles 5 and their respective first supporting poles 2 are the same.

In an embodiment as shown in FIG. 2, a driving device is installed on the hanger 1. The driving device includes a motor 10, a drive shaft 13, and sliding wheels 12. The motor 10 may be arranged inside or outside the hanger 1. Each of the first supporting poles 2 has a first sliding groove 14. The first sliding grooves 14 are opposite to each other. Each of the secondary supporting poles 5 is provided thereon with a second sliding groove 15. The second sliding grooves 15 are also opposite to each other. The first sliding groove 14 and the second sliding groove 15 are in communication. The sliding wheels 12 is able to roll in the first sliding groove 14 and the second sliding groove 15 to move the hanger 1. In an embodiment, the drive shaft 13 and the sliding wheels 12 may be directly connected together. The motor 10 can control the rotation of the drive shaft 13 to drive the two sliding wheels 12 to roll in the first sliding groove 14 and the second sliding groove 15 so as to change the position of the hanger 1. Since the first sliding groove 14 and the second sliding groove 15 are in communication with each other, when the clothes on the hanger 1 is dry, the motor 10 may drive the hanger 1 to move, so that the hanger 1 is moved from the first sliding groove 14 to the second sliding groove 15 to wait for being collected.

Figure 3A:
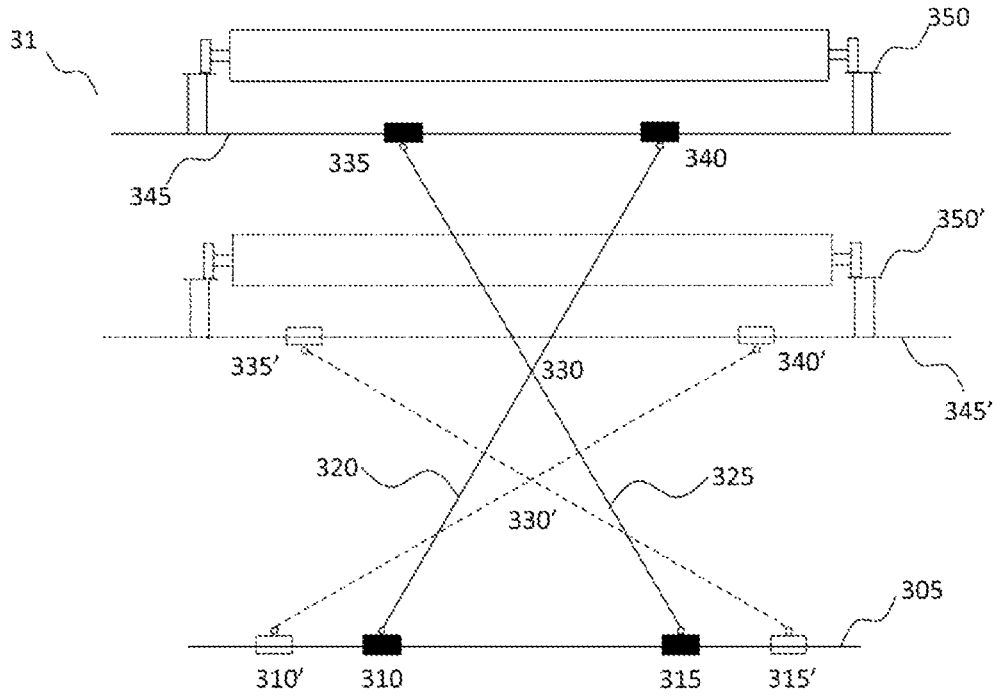
FIG. 3A schematically shows a structure diagram of a lifting mechanism used for the smart clotheshorse according to an embodiment of the present disclosure.

In an embodiment, the smart clotheshorse according to the present disclosure may include a lifting mechanism 31 so that the hanger 1 can be moved between the first sliding groove and the second sliding groove, rather than only slide from the first sliding groove to the second sliding groove by gravity. The lifting mechanism 31 can be used to switch the positions of the hangers 1. FIG. 3A shows an example of the lifting mechanism 31. In this figure, the solid line and the solid block denote the lifting mechanism 31 in a status that its top surface is elevated, and the dotted line and dotted block denote the lifting mechanism 31 in a status that its top surface is lowered. Reference numerals with single quotation marks (') indicate the components of the lifting mechanism 31 in a status that its top surface is lowered. The lifting mechanism 31 comprises a screw 305, nuts 310, 315, connecting rods 320, 325, a hinge point 330, sliders 335, 340, and a smooth axis 345. The screw 305 may be supported by the smart clotheshorse (for example, mounted on a second supporting pole 6 described below) or may also be supported by ground. The screw 305 cooperates with the nuts 310, 315. The connecting rods 320 and 325 are hinged at the hinge point 330. The smooth axis 345 cooperates with the sliders 335, 340. The lifting mechanism 31 further includes a driving mechanism, such as an electric motor, which can be used to drive the screw 305 to rotate around its axis. The threads on the screw 305 and the screw holes in the nuts 310, 315 are configured such that, when the screw 305 rotates, the nuts 310 and 315 move in opposite directions. In that situation, sliders 335, 340 also move in opposite directions to make the smooth axis 345 rise or fall, so that the top surface 350 of the lifting mechanism 31 is raised or fallen.

Figure 3B:
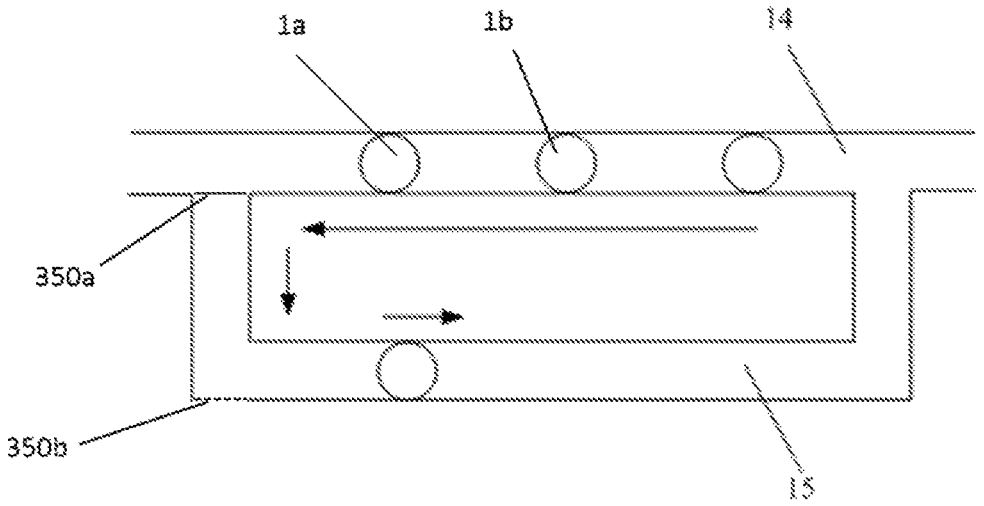
FIG. 3B schematically shows, in a side view, a schematic diagram of a hanger in a sliding groove and a movement thereof according to an embodiment of the present disclosure.

FIG. 3B shows the cooperation of the lifting mechanism 31 with the first sliding groove 14 and the second sliding groove 15. For simplicity, only the top surface 350 of the lifting mechanism 31 is shown. As shown in FIG. 3B, the top surface 350 of the lifting mechanism 31 is located in a vertical portion of the second sliding groove. In FIG. 3B, reference numerals 350*a* and 350*b* denote the same top surface 350 at different positions. At position 350*a*, the top surface 350 of the lifting mechanism 31 is flush with the bottom surface of the first sliding groove 14. At position 350*b*, the top surface 350 of the lifting mechanism 31 is flush with the bottom surface of the second sliding groove 15. The way in which the hangers 1 switch their positions by the lifting mechanism 31 will be described below by way of example. To illustrate with the perspective of FIG. 3B, assuming a hanger 1*a* is located on the left of a hanger 1*b*, when it is required to exchange the positions of the hanger 1*a* and the hanger 1*b*, the top surface 350 of the lifting mechanism 31 may be located at the position 350*a* firstly, and the hanger 1*b* is then moved onto the top surface 350. Next, the top surface 350 is moved down to the position 350*b* so that the hanger 1*b* can only be moved to the right into the horizontal part of the second sliding groove 15. Then, the top surface 350 of the lifting mechanism 31 is raised to the position 350*a*. Next, the hanger 1*a* is moved toward the top surface 350, and continues to move forward in the same direction after arriving at the top surface 350 to leave the top surface 350. Subsequently, the top surface 350 is moved down to the position 350*b*, so that the hanger 1*b* can be moved to the top surface of the lifting mechanism 31 and then moved back into the first sliding groove 14 as the top surface 350 rises. After that, the positions of the hanger 1*a* and the hanger 1*b* have been exchanged with respect to the straight line along which the first sliding groove extend.

In an embodiment, as shown in FIG. 2, the hanger 1 may further include a telescopic shaft 11. The telescopic shaft 11 and the drive shaft 13 are coaxial and connected together. A part of the telescopic shaft 11 extends out of both ends of the hanger 1, and is connected between the sliding wheel 12 and the drive shaft 13. The motor 10 can control the rotation of the drive shaft 13 to roll the two sliding wheels 12 through the telescopic shaft 11, thereby adjust the position of the hanger 1. Moreover, the amount of the telescopic shaft 11 extending out of both ends of the hanger 1 can be controlled by the motor 10 or an additional motor such that the sliding wheel 12 can leave the first sliding groove 14 or the second sliding groove 15 so that the hanger 1 may drop from the first sliding groove 14 or the second sliding groove 15.

As mentioned above, the clothes may be sunned by two or more hangers 1. The distance between the hangers 1 can be controlled such that the clothes may slide off the hangers and only hanging on the fixing hangers. In turn, the clothes can be organized preliminarily. In an embodiment, the second sliding groove can be used to accommodate the above-described fixing hanger for hanging clothes so as to further organize clothes.

In an embodiment, as shown in FIG. 1, the smart clothes-horse may further include a storage box 8 for storing dry clothes. The storage box 8 is located directly below the hanger 1. An opening may be present on a side of each secondary supporting pole 5 remote from the first supporting pole 2. There is also presented an opening at a corresponding position of the second sliding groove 15. When the humidity of the clothes on the hanger 1 is lower than the first preset humidity, the hanger 1 can be moved from the first sliding groove 14 to the second sliding groove 15 and dropped into the storage box 8 through the opening to preliminarily organize the clothes. In addition, as described above, the hanger can drop into the storage box 8 from the first sliding groove 14 or the second sliding groove 15 by controlling the amount of the telescopic shaft 11 extending out of both ends of the hanger 1.

As shown in FIG. 1, the smart clotheshorse may include a second supporting pole 6. The second supporting pole 6 is perpendicular to the ground and the first supporting pole 2, and is connected with the first supporting pole 2 to support the first supporting pole 2. The number of the second supporting poles 6 is not limited in the present disclosure.

In an embodiment, as shown in FIG. 1, the storage box 8 is provided with a cover. The plane where the cover is located is angled to the horizontal plane so that the water droplets dropped onto the cover do not accumulate on the cover when the clothes are sunning.

In an embodiment, the angle between the cover and the horizontal plane may be 10°, 20° or other degrees. In practical applications, those skilled in the art can set this angle according to actual needs. This disclosure does not limit it. The height of the edge of the cover in connection with the body is lower than the height of the rest of the cover.

In an embodiment, the projections of the respective openings of the two secondary supporting poles 5 on the horizontal plane should be in the projection of the storage box 8 on the horizontal plane, so that the hanger 1 on which the clothes are fixed is dropped directly into the storage box 8 when dropped from the opening.

In practical applications, multiple pieces of clothes may be sunned by the smart clotheshorse at the same time. When several of the multiple pieces of clothes are dry, in one embodiment, the dry clothes can drop by controlling the amount of telescopic shaft 11 extending out of both ends of the hanger 1, and in another embodiment, the hanger 1 on which the dry clothes are fixed may be firstly moved to the second sliding groove, and then when all clothes are dry, these clothes are stored together in the storage box 8 by withdrawing the telescopic shaft 11 or by means of the opening of the secondary supporting pole 5.

In an embodiment, a second preset humidity information regarding the humidity of the cover may also be set in advance. The cover is kept closed when the humidity of the cover is higher than the second preset humidity, and the cover can be controlled to open when the humidity of the cover is less than or equal to the second preset humidity.

As shown in FIG. 1, a second humidity sensor 7 is provided at the bottom of the cover of the storage box 8. The second humidity sensor 7 can be used to detect the humidity of the cover of the storage box 8. An opening-and-closing control device is further provided on the cover (for example, at a connection position between the cover and the body). The opening-and-closing control device can control the opening and the closing of the cover based on the humidity of the cover detected by the second humidity sensor 7. Specifically, the opening-and-closing control device may open the cover when the humidity of the cover is less than or equal to the second preset humidity. When the humidity of the cover is higher than the second preset humidity, the opening-and-closing control device can keep the cover closed, so as to prevent the accumulated water on the cover from flowing into the storage box 8, while prevent the dust in the air from falling into the storage box.

In an embodiment, when the humidity of the cover detected by the second humidity sensor 7 is less than or equal to the second preset humidity, the opening-and-closing control device may control the cover based on the humidity of the clothes on the hangers 1. Specifically, when the humidity of the clothes on the hangers 1 is higher than the first preset humidity (which indicates that these clothes are not yet dry), the opening-and-closing control device can keep the cover closed. When the humidity of the clothes is less than or equal to the first preset humidity (which indicates that the clothes are already dry), the opening-and-closing control device may open the cover to collect the dry clothes into the storage box 8.

In a specific implementation, when the clothes on the hanger 1 are dry, the driving device drives the hanger 1 to move to the second sliding groove 15 and drops together with the clothes from the opening of the second sliding groove 15 into the storage box 8. In another specific implementation, when the clothes on the hanger 1 are dry, the control device controls the telescopic shaft 11 at both ends of the hanger 1 to withdraw, so that the sliding wheels 12 leave the sliding groove, such that the hanger 1 falls into the storage box 8. When all clothes on the hanger 1 are collected in the storage box 8, the opening-and-closing control device on the storage box 8 can close the cover of the storage box 8.

It can be understood that, in practical applications, when there is no clothes on the smart clotheshorse, that is, when the smart clotheshorse is in an idle state, the cover of the storage box is kept closed. This can prevent dust from falling into the storage box, thereby keep the storage box clean.

As shown in FIG. 1, the smart clotheshorse may further include a water tank 9. The water tank 9 may surround the storage box 8 or a part of the body (for example, at opposite sides of the body, in particular, both sides where the cover and the body are connected). The water tank 9 is used to store the water droplets dropped on the cover of the storage box 8 when the clothes is sunning. The height of the opening of the water tank 9 is lower than the height of the edge of the storage box 8, which can ensure that the water droplets on the cover of the storage box 8 easily slide into the water tank 9.

In an embodiment, the distance between two adjacent hangers 1 may be set to 10 cm. When sunning the clothes, in order to increase the sunning area of the clothes, two hangers 1 may be used to sun one piece of clothes. Obviously, it is also possible to use three or more hangers 1 to dry one piece of clothes.

The smart clotheshorse provided by the embodiments of the present disclosure allows the hanger to slide along the first supporting poles parallel to each other. The smart clotheshorse can adjust the position of the hanger based on the environmental information of the hanger (including, for example, the humidity information and/or the light intensity information). Therefore, comparing with the known clotheshorse devices, the smart clotheshorse provided by the embodiment of the present disclosure can automatically adjust the position of the hanger based on the environmental information of the hanger, thereby greatly increasing the drying speed of the clothes without manually adjusting the position of clothes on the hanger, thus reducing the workload of people.

Figure 4:
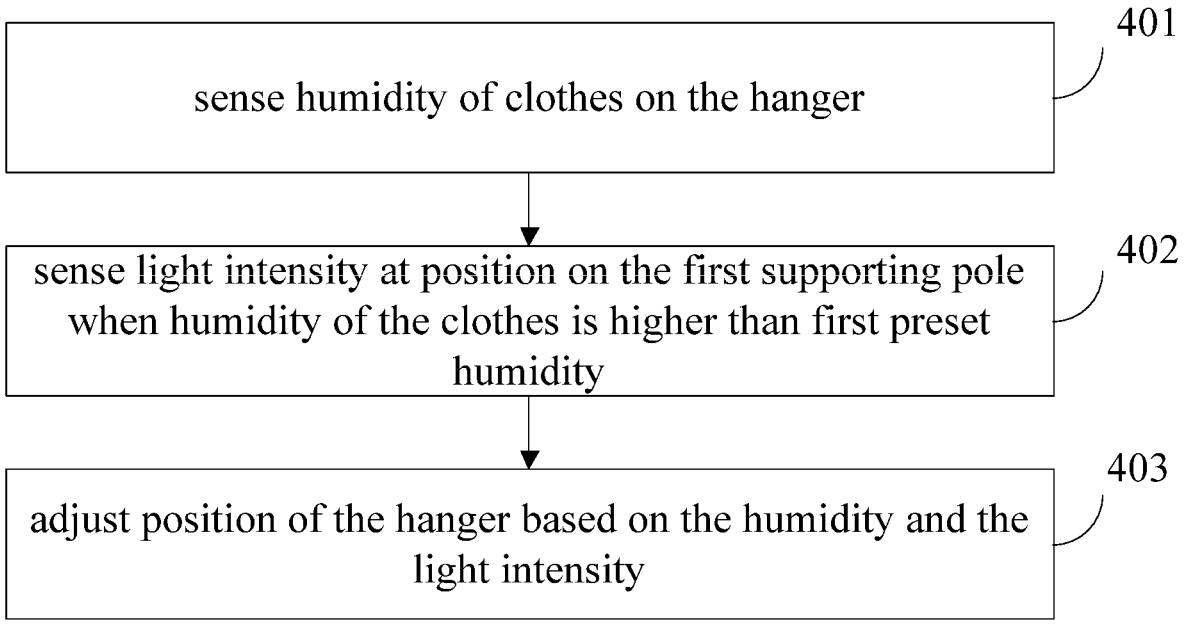
FIG. 4 shows a flow chart of a method for controlling a hanger in a smart clotheshorse according to an embodiment of the present disclosure.

According to another aspect of the present disclosure, there is provided a method for controlling a hanger in a smart clotheshorse. FIG. 4 schematically shows a flow chart of the method. This method can be used for the smart clotheshorse according to any of the above embodiments. This method is described in detail below.

First, the humidity of the clothes placed on the hanger is sensed (step 401). In an embodiment, a first humidity sensor is placed on the hanger. The first humidity sensor can sense the humidity of the clothes on the hanger in real time. When the humidity is higher than the first preset humidity, the light intensity at each position on the first supporting pole is sensed (step 402).

In an embodiment, first preset humidity information of the clothes on the hanger may be set in advance. When the humidity of the clothes on the hanger is higher than the first preset humidity, the position of the hanger may be adjusted based on the humidity of the clothes on the hanger. When the humidity of the clothes on the hanger is less than or equal to the first preset humidity, the position of the hanger may be adjusted so as to collect the clothes on the hanger.

A light intensity sensor is placed on the first supporting pole. The light intensity sensor can sense the light intensity at various positions of the first supporting pole. When the humidity of the clothes on the hanger sensed by the first humidity sensor is less than or equal to the first preset humidity (which indicates that the clothes on the hanger are already dry), the clothes on the hanger may be collected. In an embodiment, the hanger may be moved by the motor to the underlying second sliding groove in order to prepare for the collection of the clothes. When the humidity of the clothes on the hanger sensed by the first humidity sensor is higher than the first preset humidity (which indicates that the clothes on the hanger are not yet dry), the light intensity sensor sense the light intensity at various positions of the first supporting pole.

After the light intensity at various positions on the first supporting pole is sensed, the position of the hanger is adjusted based on the humidity and the light intensity (step 403).

Step 403 may specifically include moving the clothes having the highest humidity to a position with the highest light intensity.

Specifically, when only one piece of clothes is sunned on the smart clotheshorse, a control device can directly move the hanger to a position with a highest light intensity on the first supporting pole based on the light intensity at various positions on the first supporting pole, to accelerate the sunning of the clothes.

When there are multiple pieces of clothes on the smart clotheshorse, the control device controls the driving device to move the clothes with a higher humidity to the position with a higher light intensity and move the clothes with a lower humidity to a position with a lower light intensity for sunning, according to the humidity of the clothes on the hanger and the light intensity at various positions on the first supporting pole, to accelerate the drying of the clothes as a whole. In other words, the ranking of the humidity of the clothes corresponds to the ranking of the light intensity at the positions where the hangers holding the closet are located. For example, the ranking of the light intensity at the position where the clothes with the largest (top 1) humidity is the first place among the light intensities at respective positions of all clothes, and the light intensity at the position where the clothes with the second place humidity is located is the second among the light intensities at respective positions of all clothes, and so on.

A relatively special situation is that the clothes with a lower humidity are located at a side of the first supporting pole where the light intensity is higher, while the clothes with a higher humidity are located at a side where the light intensity is lower. For example, as shown in FIG. 3B, in an embodiment, the humidity of the clothes on the hanger 1*a* is lower than the humidity of the clothes on the hanger 1*b*, while the light intensity at the positions of the hanger 1*a* is higher and the light intensity at the positions of the hanger 1*b* is lower. In this case, in order to enable the clothes with the higher humidity to subject the higher light intensity, it is required to exchange the positions of these two hangers. Below is an exemplary method to do enable it. Firstly, the hanger 1*a* is moved into the second sliding groove, and then the top surface of the lifting mechanism is raised to flush with the first sliding groove. Next, the hanger 1*b* s moved to the left of a left vertical part of the second sliding groove. Subsequently, the top surface of the lifting mechanism is fallen to flush with the second sliding groove so that the hanger 1*a* can be moved to the top surface of the lifting mechanism. Then the top surface of the lifting mechanism is raised to flush with the first sliding groove. At this time, the positions of the hangers 1*a* and 1*b* have been exchanged with respect to the straight line where the first sliding groove is located. Then, the hanger 1*a* can be moved to the original position of the hanger 1*b*, or the position with the highest light intensity. Finally, the hanger 1*b* is moved to the original position of the hanger 1*a* or other suitable position. It should be noted that the width of the vertical part of the second sliding groove is not limited to allowing only one hanger to pass. For example, the width of the vertical part of the second sliding groove may be larger than or equal to the sum of the diameters of two or more hangers.

It can be understood that the above examples are merely used for a better understanding of the technical solutions of the embodiments of the present disclosure and are not intended to limit the embodiments of the present disclosure.

In an embodiment, the smart clotheshorse may further include a storage box. A method for controlling the opening and the closing of the cover of the storage box is described below in detail.

Firstly, acquire the humidity of the cover of the storage box (step S1). There is an opening-and-closing control device on the cover of the storage box. The opening-and-closing control device can be used to control the opening and the closing of the cover. When the clothes are sunned on the smart clotheshorse, the cover of the storage box remains closed. This can prevent water droplets from falling into the storage box from the wet clothes.

There is a second humidity sensor at the bottom of the cover of the storage box. The second humidity sensor can be used to sense the humidity of the cover of the storage box. When the humidity of the cover is less than or equal to a second preset humidity, the first humidity sensor may sense the humidity of the clothes on the hanger (step S2).

In an embodiment, the second preset humidity corresponding to the humidity of the cover may be set in advance. According to the sensed humidity of the cover, when the humidity of the cover is higher than the second preset humidity, the opening-and-closing control device can control the cover to remain closed. When the humidity of the cover is less than or equal to the second preset humidity, the opening-and-closing control device may acquire the humidity of the clothes on the hangers. When the humidity of the clothes is lower than or equal to the first preset humidity (which indicates that the clothes are already dry), the opening-and-closing control device may open the cover (step S3) to collect the dry clothes into the storage box. When the humidity of the clothes is higher than the first preset humidity (which indicates that the clothes are not dry), the opening-and-closing control device keeps the cover closed. This prevents the dust in the air from falling into the storage box while preventing the water droplets from falling into the storage box.

By means of the method for controlling the hanger in the smart clotheshorse provided by the embodiment of the present disclosure, the position of the hanger can be automatically adjusted based on the environmental information of the hanger, which greatly accelerates the drying of the clothes. Moreover, there is no deed to adjust manually the position of the hanger holding the clothes, therefore people's workload is reduced.

In summary, the present disclosure provides a smart clotheshorse comprising: first supporting poles parallel to each other; a hanger connected between the first supporting poles and configured to be slidable along the first supporting poles, the hanger comprising a driving device and a control device; and a sensing device. The sensing device is configured to sense environmental information of the hanger. The environmental information comprises at least one of humidity information and light intensity information. The control device is configured to control the driving device based on the environmental information. The driving device is configured to drive the hanger to slide along the first supporting poles.

The foregoing embodiments of the method are expressed as a combination of a series of actions for the sake of simplicity, but those skilled in the art should understand that the present disclosure is not limited by the order in which the actions are described. The steps can be performed in other orders or simultaneously according to the present disclosure. Second, those skilled in the art should also understand that some of the actions and modules involved in the embodiments described in the specification are not necessarily required.

The embodiments in this specification are described in a progressive manner, each of which focuses on the difference from another. For the same or similar parts among the embodiments, reference may be made to each other.

Finally, it should also be noted that the terms such as first, second, and firstly, then, next, subsequently, finally and the like, are only used herein to distinguish one entity or operation from another, without necessarily requiring or implying that any sequential relationship exists between these entities or operations. Moreover, the terms "include", "comprise", or any conjugation thereof are intended to cover element in a non-exclusive way such that a process, method, article, or device that comprises a list of elements includes not only those elements but also the element not explicitly listed. Other elements inherent to such processes, methods, articles, or devices may also be included. Without specific limitation, the element preceded by the expression of "comprise a . . . " does not exclude the presence of other elements in the process, method, article, or device that includes the element.

The smart clotheshorse and the method for controlling a hanger provided by the present disclosure have been described above in detail. Specific examples are used in the present disclosure to explain the principle and implementation of the present disclosure. The above description of the embodiment is only used to help understand the core idea of the present disclosure. Meanwhile, according to the idea of the present disclosure, those skilled in the art may conceive further changes with respect to the specific implementation and application range. In summary, the content of the specification should not be construed as a limitation to the present disclosure.

What is claimed is:

1. A smart clotheshorse comprising:

first supporting poles parallel to each other, each of the first supporting poles comprising a first sliding groove, and the first sliding grooves are opposite to each other;

secondary supporting poles connected with the first supporting poles, each of the secondary supporting poles comprising a second sliding groove, the second sliding grooves being opposite to each other and in communication with the corresponding first sliding grooves respectively;

at least one hanger connected between the first supporting poles and configured to be slidable along the first supporting poles, each of the at least one hangers comprising a driving device and a control device, the driving device comprising a motor, a drive shaft and a sliding wheel; and a sensing device;

wherein the sensing device is configured to sense environmental information of the at least one hanger, wherein the environmental information comprises at least one of humidity information and light intensity information;

wherein the control device is configured to control the driving device based on the environmental information;

wherein the driving device is configured to drive each of the at least one hangers to slide along the first supporting poles; and wherein the motor is configured to control rotation of the drive shaft to cause the sliding wheel to move in the first sliding groove or the second sliding groove.

2. The smart clotheshorse of claim 1, wherein the sensing device comprises a first humidity sensor located at the at least one hanger and a light intensity sensor located at the first supporting pole;

wherein the first humidity sensor is configured to sense humidity of the clothes on the at least one hanger; and wherein the light intensity sensor is configured to sense a light intensity at a position on the first supporting pole.

3. The smart clotheshorse of claim 1, wherein a side of the second sliding groove away from the first supporting pole has an opening.

4. The smart clotheshorse of claim 1, further comprising a lifting mechanism configured to make its top surface rise and fall in a vertical part of the second sliding groove, such that the top surface forms a part of the first sliding groove or the second sliding groove.

5. The smart clotheshorse of claim 1, wherein the driving device further comprises a telescopic shaft extending out of both ends of each of the at least one hangers in an axial direction of each of the at least one hangers and connected to two sliding wheels respectively, wherein a distance by which the telescopic shaft extends out of both ends of each of the at least one hangers is controlled.

6. The smart clotheshorse of claim 1, further comprising a second supporting pole perpendicular to and connected with the first supporting pole.

7. The smart clotheshorse of claim 1, further comprising a storage box located directly below the at least one hanger.

8. The smart clotheshorse of claim 7, wherein the storage box comprises a body and a cover connected with the body, the cover is angled with a horizontal plane, and a height of an edge of the cover connected with the body is lower than heights of other parts of the cover.

9. The smart clotheshorse of claim 8, wherein the cover has a second humidity sensor and an opening-and-closing control device;

wherein the second humidity sensor is configured to sense humidity of the cover; and wherein the opening-and-closing control device is configured to control opening and closing of the cover based on the humidity of the cover.

10. The smart clotheshorse of claim 8, further comprising a water tank, wherein the water tank is arranged to closely adjoins to the body at a lower side of the cover.

11. The smart clotheshorse of claim 1, wherein the at least one hanger comprises a plurality of hangers, and a distance between two neighboring ones of the plurality of hangers is 10 cm.

12. The smart clotheshorse of claim 1, wherein a number of the at least one hangers is 16 to 18.

13. A method for controlling at least one hanger in a smart clotheshorse, the smart clotheshorse comprising:

first supporting poles parallel to each other;

at least one hanger connected between the first supporting poles and configured to be slidable along the first supporting poles, each of the at least one hangers comprising a driving device and a control device;

a sensing device; and a storage box;

wherein the sensing device is configured to sense environmental information of the at least one hanger, wherein the environmental information comprises at least one of humidity information and light intensity information;

wherein the control device is configured to control the driving device based on the environmental information; and wherein the driving device is configured to drive the at least one hanger to slide along the first supporting poles, the method comprising:

sensing humidity of clothes on the at least one hanger;

sensing a light intensity at a position on the first supporting pole when the humidity of the clothes is higher than a first preset humidity;

adjusting a position of the at least one hanger based on the humidity and the light intensity;

sensing the humidity of a cover of the storage box;

acquiring the humidity of the clothes on the at least one hanger when the humidity of the cover is less than or equal to second preset humidity; and opening the cover when the humidity of the clothes is less than or equal to the first preset humidity.

14. The method of claim 13, wherein the adjusting the position of the at least one hanger based on the humidity and the light intensity comprises:

moving one of the at least one hangers, the clothes on which having the highest humidity, to a position with the highest light intensity.

15. The method of claim 14, wherein the at least one hanger comprises a plurality of hangers, and the adjusting the position of the at least one hanger based on the humidity and the light intensity further comprises:

adjusting the position of the plurality of hangers, on which the clothes are hanged respectively, such that a ranking of the humidity of the clothes corresponds to a ranking of the light intensities at an adjusted position of the plurality of hangers.

16. The method of claim 15, wherein the first supporting pole comprises a first sliding groove, and the smart clotheshorse further comprises a secondary supporting pole connected with the first supporting pole and a lifting mechanism, wherein the secondary supporting pole comprises a second sliding groove, and the second sliding grooves are in communication with the corresponding first sliding grooves respectively, wherein the lifting mechanism is configured to make its top surface rise and fall in a vertical part of the second sliding groove, so that the top surface forms a part of the first sliding groove or the second sliding groove, the method further comprising:

exchanging the sequence of the positions of a first hanger and a second hanger of the at least one hanger in the first sliding groove through the lifting mechanism.

17. The method of claim 16, wherein the exchanging the sequence of the positions of the first hanger and the second hanger in the first sliding groove through the lifting mechanism comprises:

moving the first hangers to the top surface of the lifting mechanism;

making the top surface of the lifting mechanism fall such that the top surface is flush with a bottom surface of the second sliding groove;

moving the first hangers such that the first hangers leaves the top surface of the lifting mechanism;

raising the top surface of the lifting mechanism such that the top surface is flush with a bottom surface of the first sliding groove;

moving the second hanger at one side of the vertical part of the second sliding groove to the other side of the vertical part of the second sliding groove in the first sliding groove;

making the top surface of the lifting mechanism fall such that the top surface is flush with the bottom surface of the second sliding groove;

moving the first hanger to the top surface of the lifting mechanism; and raising the top surface of the lifting mechanism such that the top surface is flush with the bottom surface of the first sliding groove.

* * * * *